US011377183B2

(12) United States Patent
Du et al.

(10) Patent No.: US 11,377,183 B2
(45) Date of Patent: Jul. 5, 2022

(54) AUTONOMOUS UNDERWATER VEHICLE (AUV) LAUNCH AND RECOVERY DEVICE DRIVEN BY ELASTIC LINKAGE MECHANISM FOR EXTRA-LARGE UNMANNED UNDERWATER VEHICLE (XLUUV)

(71) Applicant: Northwestern Polytechnical University, Xi'an (CN)

(72) Inventors: Xiaoxu Du, Xi'an (CN); Zhenyi Lan, Xi'an (CN); Guang Pan, Xi'an (CN); Baowei Song, Xi'an (CN)

(73) Assignee: NORTHWESTERN POLYTECHNICAL UNIVERSITY, Xi'an (CN)

( * ) Notice: Subject to any disclaimer, the term of this patent is extended or adjusted under 35 U.S.C. 154(b) by 50 days.

(21) Appl. No.: 17/039,301

(22) Filed: Sep. 30, 2020

(65) Prior Publication Data

US 2021/0129960 A1 May 6, 2021

(30) Foreign Application Priority Data

Nov. 5, 2019 (CN) ..... 201911068929.7

(51) Int. Cl.
*B63G 8/00* (2006.01)

(52) U.S. Cl.
CPC ..... *B63G 8/001* (2013.01); *B63G 2008/004* (2013.01); *B63G 2008/008* (2013.01)

(58) Field of Classification Search
CPC ..... B63G 8/001; B63G 2008/004; B63G 2008/008; B63C 11/52
See application file for complete search history.

(56) References Cited

U.S. PATENT DOCUMENTS

| | | | | |
|---|---|---|---|---|
| 7,798,086 | B2 * | 9/2010 | Ruggaber | B63G 8/32 114/238 |
| 9,592,895 | B2 * | 3/2017 | Yu | B63G 8/001 |
| 10,351,212 | B2 * | 7/2019 | Jourdan | B63B 21/66 |
| 10,618,615 | B1 * | 4/2020 | Wiedemeier | B63B 27/36 |

FOREIGN PATENT DOCUMENTS

| | | |
|---|---|---|
| CN | 107697247 A | 9/2019 |
| CN | 108569385 A | 9/2019 |

* cited by examiner

*Primary Examiner* — Anthony D Wiest
(74) *Attorney, Agent, or Firm* — Kilpatrick Townsend & Stockton, LLP

(57) ABSTRACT

The present disclosure relates to an autonomous underwater vehicle (AUV) launch and recovery device driven by an elastic linkage mechanism for an extra-large unmanned underwater vehicle (XLUUV). The AUV launch and recovery device includes a hydraulic device, a push plate and a tubular device box, where the tubular device box adopts a frame-type tubular structure with a closed end; the push plate is fixed to a hydraulic rod, the hydraulic rod is controlled to stretch, and furthermore, the push plate is controlled to radially slide in a groove; and as the push plate is controlled to move radially, an inner diameter of a ring part of the inelastic linkage rope is narrowed or enlarged, so that inelastic hauling ropes are pulled to move axially, and the front end of the elastic rubber plates is further pulled to achieve an expanding or contracting state of an recovery/launch opening.

8 Claims, 7 Drawing Sheets

AUTONOMOUS UNDERWATER VEHICLE (AUV) LAUNCH AND RECOVERY DEVICE DRIVEN BY ELASTIC LINKAGE MECHANISM FOR EXTRA-LARGE UNMANNED UNDERWATER VEHICLE (XLUUV)

FIELD

The present disclosure relates to the field of underwater vehicles, in particular to an autonomous underwater vehicle (AUV) launch and recovery device driven by an elastic linkage mechanism for an extra-large unmanned underwater vehicle (XLUUV).

BACKGROUND

With development of marine resources and change in strategic situation of coastal defense, an unmanned long-time underwater operation became a hotspot, and various countries stepped up development of large unmanned underwater systems and research on technologies related to the large unmanned underwater systems.

The large unmanned underwater systems are large unmanned underwater integrated operation platforms with sensors, weapons and other loads, and the large unmanned underwater integrated operation platforms can be controlled remotely, and semi-autonomously or autonomously to operate. Compared with small and medium unmanned systems, the large unmanned underwater systems have the advantages of being longer in range and working time, lower in dependence on a manned platform, smaller in influence on marine environment, higher in reliability, autonomous operational capability and cost effectiveness, and the like. The characteristic of the large-scale unmanned underwater system is that it adopts open structure and modular design, so that the large-scale unmanned underwater system can reconstruct the payload and tasks, replace a manned platform to carry out most ISR tasks and undertake anti-submarine and attack operations. At present, the United States Navy continuously accelerates a research, development and deployment process of large unmanned underwater systems, and a proposed "extra-large unmanned underwater vehicle (XLUUV)" is a large unmanned underwater vehicle which is provided with modular load cabins and executes high-risk tasks being long in navigation time and needing to avoid personal casualties. Based on this, an AUV launch and recovery device is designed by using an XLUUV as an underwater recovery platform, so that the XLUUV can carry a small AUV. The XLUUV launches AUV into complex water to carry out tasks and recovers the AUV underwater to supplement energy for reuse. This working mode not only can improve the combat effectiveness, but also greatly improve the efficiency cost ratio.

The AUV launch and recovery technology for the extra-large unmanned underwater vehicle is still in an initial stage. There are few documents and data with this regard. For example, CN107697247A provides an AUV underwater launch and recovery device, but a flared shaped structure of the device cannot form an airtight cage-shaped structure due to mechanical structure limitation, and an additional space is required for installation of a driving device. CN108569385A provides an AUV underwater recovery locking mechanism which has the main defect that a flared shaped structure at a front end of a recovery mechanism cannot be closed. The present disclosure adopts "Echo Voyager" extra-large unmanned underwater vehicle of the Boeing Company as a template, and provides an AUV launch and recovery device using the XLUUV to achieve underwater launch and recovery of AUVs; and the device can play a significant role not only in the military field but also in marine science and other fields, and finish various underwater operation tasks more reliably and efficiently.

SUMMARY

Problems to be solved by the present disclosure: to avoid defects existing in the prior art, the present disclosure provides an autonomous underwater vehicle (AUV) launch and recovery device driven by an elastic linkage mechanism for an extra-large unmanned underwater vehicle (XLUUV); the AUV launch and recovery device launches and recovers small and medium rotary AUVs under navigation with cooperation between elastic rubber plates and inelastic hauling ropes, and this device has a simple and compact structure and reliable actions; and this AUV launch and recovery device is a feasible device for launching and recovering the small and medium rotary AUVs.

Embodiments of the present disclosure are as follows: the AUV launch and recovery device driven by the elastic linkage device for the XLUUV includes a tail end fixing box body, a tail end limit displacement block, a tail end driving case, a hydraulic device, a push plate, a tubular device box and an external sleeve. The AUV launch and recovery device is a frame type tubular structure, one end of the AUV launch and recovery device is a recovery end, the other end is closed, and this end is coaxially fixed with the tail end fixing box body through the tail end limit displacement block; the front end face of the tail end fixing box body is processed with a groove, and the groove position is in the radial direction of the tail fixed box body. The push plate is parallel to the central axis of the AUV launch and recovery device, and one end of the push plate is installed in cooperation with the groove of the tail end fixing box body. The hydraulic device is installed in the tail end driving case, and the hydraulic rod of the hydraulic device can extend out of the tail end driving case. The push plate is fixed to the hydraulic rod, and the control system controls the movement of the hydraulic rod to make the push plate move radially in the groove.

The external sleeve coaxially sleeves the periphery of the AUV launch and recovery device, and is used for fixing the whole AUV launch and recovery device to the XLUUV; and the tail end driving case is positioned by an L-shaped driving case positioning tube fixed to a peripheral surface of the external sleeve.

The tubular device box includes a tail end sleeve positioning plate, an impact cushion, metal guide rods, annular AUV positioning plates, elastic AUV positioning rings, front end sleeve positioning plates, elastic rubber plates, inelastic hauling ropes, front end elastic rings and an inelastic linkage rope, where the tail end sleeve positioning plate, the annular AUV positioning plates and the front end sleeve positioning plates are sequentially and coaxially arranged, and the metal guide rods are uniformly distributed circumferentially, and penetrate through holes in edges of the annular AUV positioning plates; one end of each metal guide rod is fixed to an inner side surface of the tail end sleeve positioning plate, the other end is fixed to inner side ring surfaces of the front end sleeve positioning plates, and all metal guide rods are arranged in a circle; the tail end sleeve positioning plate adopts a circular plate structure, and the impact cushion is coaxially fixed to an inner side surface of the tail end sleeve positioning plate; the tail end sleeve positioning plate is coaxially fixed to the front end elastic ring; all annular AUV positioning plates and front sleeve positioning plates are annular structure, the annular structure is processed with two types of holes for installing the metal guide rods and the inelastic hauling ropes, and the elastic AUV positioning rings are coaxially installed on ring inner hole walls of the annular AUV positioning plates and the front end sleeve positioning plates; the elastic AUV positioning rings are made of elastic materials, and inner hole diameters of the elastic AUV positioning rings are smaller than an outer diameter of an AUV to be recovered; the AUV to be recovered is located through friction and elastic force generated by elastic deformation; one elastic rubber plate is taken as an example, one end of the elastic rubber plate is installed with a threaded cylinder, which passes through the annular hole of the front sleeve positioning plate and is fixed with an metal guide rod; all elastic rubber plates form a circular arrangement; and one front end elastic ring is taken as an example, the original structure is an elastic rope. One end passes through all holes in the same circular plane of all elastic rubber plates to form a closed elastic ring. All the front end elastic rings and elastic rubber plates form an elastic structure, which can form a cage structure or a bell mouth structure. The number of inelastic hauling ropes and elastic rubber plates is the same. Take one inelastic hauling rope as an example, the inelastic hauling rope is parallel to the axis of the tail end limit displacement block in the tubular device box, the front end of the inelastic hauling rope is fixed to the front end of the elastic rubber plates and the tail end passes through the hole of the annular AUV positioning plate in turn and finally fixed on the tail end fixing box body. After the installation process, all the inelastic hauling ropes form a cylindrical tubular structure, and all the inelastic hauling ropes are in tension state.

The inelastic linkage rope is installed between the tail end fixing box and the tail end sleeve positioning plate, one end of the inelastic linkage rope is fixed on the tail end driving case, the other end passes through the hole on the surface of the push plate, bypasses all the inelastic hauling ropes arranged in a circle, passes through another hole on the push plate and is fixed on the tail end driving case to form a closed ring, and all the inelastic hauling ropes are closed inside the ring. The hydraulic rod controls the push plate to move upward or downward, and makes the annular center formed by the inelastic linkage rope shrink or expand, so that the elastic rope moves axially by relative motion, further pulls the front ends of the elastic rubber plates to achieve the open or close state of the front end elastic structure.

Further, the tail end fixing box body adopts a cylindrical structure, and a threaded hole is formed in a center of the fixing box body. The tail end limit displacement block is a stepped cylindrical structure, which is fixed with the tail fixed box body through thread installation.

Further, the tail end sleeve positioning plate and a plurality of the annular AUV positioning plates and the front end sleeve positioning plates are arranged equidistantly.

Further, The guide rod positioning sleeve are installed on the guide rod, and both sides of each AUV positioning plate need to be installed to prevent the AUV positioning plate from moving.

Further, the inelastic hauling ropes are parallel to the axis of the tail top block in the tubular device box.

Further, one elastic rubber plate is taken as an example, one end of the elastic rubber plate is installed with a threaded cylinder, which passes through the hole of the front sleeve positioning plate and is fixed with the metal guide rod. The number of elastic rubber plates is the same as that of the metal guide rods. All elastic rubber plates form an approximate cylindrical structure after installation.

Further, one end of an external sleeve is coaxially fixed to an inner ring surface of the front end sleeve positioning plates, and the other end of the external sleeve is coaxially fixed to an inner side surface of the tail end sleeve positioning plate.

Further, the device further includes two pairs of sleeve brackets arranged in parallel, and the sleeve brackets are fixed to a bottom of the external sleeve, fix the whole AUV launch and recovery device to the XLUUV or install the device in the XLUUV.

BENEFICIAL EFFECTS

The present disclosure has the beneficial effects: the present disclosure integrates all required devices for AUV launch and recovery into a small tubular device, especially including a driving device, and the structure is compact; AUVs can be recovered into an XLUUV, or can be hung at an exterior of the XLUUV as an external load; during launch and recovery of the AUVs, actions of opening and closing a guide cover port at a recovery end are finished through relative motion with cooperation among a hydraulic device, elastic ropes and inelastic ropes, and therefore, an overall length of the AUV launch and recovery device is shortened; and the device has a simple structure and low manufacturing costs. Furthermore, an installation space is reduced, and possibility that the XLUUV carries more small AUVs is improved, improving the cost effectiveness.

Under a condition that the AUVs go out to execute tasks or are locked, the front end flared shaped guide cover of the AUV launch and recovery device is almost closed completely, so that an enclosed space is formed in the tubular device box; and a risk that an inner part of the device is blocked by large foreign matter and consequently recovery is affected, is reduced.

The AUV launch and recovery device not only can be recovered into the XLUUV, but also can be hung at an outer part of an underwater platform as an external load. As the guide cover can be opened and closed as required, it can slow down the hydrodynamic decline of the original large-scale underwater platform.

REFERENCE NUMERALS

1. XLUUV; 2. revolving AUV launch and recovery device; 3. tail end fixing box body; 4. tail end limit displacement block; 5. tail end sleeve positioning plate; 6. impact cushion; 7. metal guide rod; 8. annular AUV positioning plate; 9. guide rod positioning sleeve; 10. elastic AUV positioning ring; 11. external sleeve; 12. front end sleeve positioning plate; 13. elastic rubber plate; 14. front end elastic ring (refers to a flexible ring structure formed by the combination of a closeable elastic rope and an elastic rubber plate); 15. inelastic hauling rope; 16. sleeve bracket; 17. inelastic linkage rope; 18. push plate; 19. hydraulic rod; 20. tail end driving case; 21. driving case positioning tube; 22. AUV; 23. groove; 24. central axis; 25. thread; 26. ring inner hole wall; 27. threaded cylinder; 28. annular hole; 29. hole; and 30. threaded hole.

DETAILED DESCRIPTION

Examples described below with reference to accompanying drawings are illustrative, which are merely intended to explain the present disclosure, rather than to limit the present disclosure.

In the description of the present disclosure, it should be noted that terms "central", "longitudinal", "transverse", "length", "width", "thickness", "upper", "lower", "front", "back", "left", "right", "vertical", "horizontal", "top", "bottom", "inner", "outer", "clockwise", "anticlockwise" and the like, are used to indicate orientations or position relationships shown in accompanying drawings. It should be noted that these terms are merely intended to facilitate a simple description of the present disclosure, rather than to indicate or imply that the mentioned apparatus or elements must have the specific orientation or be constructed and operated in the specific orientation. Therefore, these terms may not be construed as a limitation to the present disclosure.

In this embodiment, for a whole launch and recovery device and any parts in the device, define one end close to a recovery end axially, as "a front end", and the other end as "a tail end" correspondingly.

Figure 1:
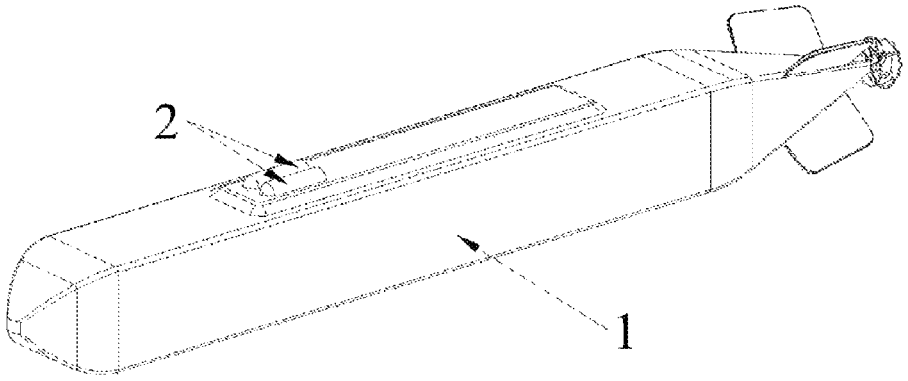
FIG. 1 shows a three-dimensional structure diagram of an AUV launch and recovery device for an XLUUV.

Refer to FIG. 1, the whole recovery device is placed in an extra-large unmanned underwater vehicle. The device is located above the underwater vehicle during launch and recovery.

Refer to FIG. 2-FIG. 4*a*, the AUV launch and recovery device driven by an elastic linkage device for an XLUUV includes a tail end fixing box body 3, a tail end limit displacement block 4, a tail end driving case 20, a hydraulic device 19, a push plate 18, a tubular device box and an external sleeve 11. The AUV launch and recovery device is a frame type tubular structure, the front end of the AUV launch and recovery device is a recovery end, the tail end is closed, and this end is coaxially fixed with the tail fixing box body 3 through the tail end limit displacement block 4; the front end face of the tail end fixing box body 3 is processed with a groove 23, and the groove position is processed in the radial direction of the tail end fixing box body 3. The push plate 18 is parallel to the central axis 24 of the AUV launch and recovery device, and one end of the push plate 18 is installed in cooperation with the groove 23 of the tail end fixing box body 3. The hydraulic device 19 is installed in the tail end driving case 20, and the hydraulic rod 19 of the hydraulic device can extend out of the tail end driving case 20. The push plate 18 is fixed to the hydraulic rod 19, and the control system controls the movement of the hydraulic rod 19 to make the push plate move radially in the groove 23.

The external sleeve 11 coaxially sleeves the periphery of the AUV launch and recovery device, and is used for fixing the whole AUV launch and recovery device to the XLUUV; and the tail end driving case 20 is positioned by an L-shaped driving case positioning tube 21 fixed to a peripheral surface of the external sleeve 11.

The tubular device box includes a tail end sleeve positioning plate 5, an impact cushion 6, metal guide rods 7, annular AUV positioning plates 8, elastic AUV positioning rings 10, front end sleeve positioning plates 12, elastic rubber plates 13, inelastic hauling ropes 15, front end elastic rings 14 and an inelastic linkage rope 17, where the tail end sleeve positioning plate 5, the annular AUV positioning plates 8 and the front end sleeve positioning plates 12 are sequentially and coaxially arranged, and the metal guide rods 7 are uniformly distributed circumferentially, and penetrate through holes in edges of the annular AUV positioning plates 8; one end of each metal guide rod 7 is fixed to an inner side surface of the tail end sleeve positioning plate 5, the other end is fixed to inner side ring surfaces of the front end sleeve positioning plates 12, and all metal guide rods 7 are arranged in a circle; the tail end sleeve positioning plate 5 adopts a circular plate structure, and the impact cushion 6 is coaxially fixed to an inner side surface of the tail end sleeve positioning plate 5; the tail end sleeve positioning plate 5 is coaxially fixed to the front end elastic ring 14; all annular AUV positioning plates 8 and the front end sleeve positioning plates 12 are an annular structure, the annular structure is processed with two types of holes for installing the metal guide rods 7 and the inelastic hauling ropes 15, and the elastic AUV positioning rings 10 are coaxially installed on ring inner hole walls 26 of the annular AUV positioning plates and the front end sleeve positioning plates; the elastic AUV positioning rings 10 are made of elastic materials, and inner hole diameters of the elastic AUV positioning rings 10 are smaller than an outer diameter of an AUV 22 to be recovered; the AUV 22 to be recovered is located through friction and elastic force generated by elastic deformation; and one elastic rubber plate 13 is taken as an example, tail end of the elastic rubber plate 13 is installed with a threaded cylinder 27, which passes through the annular hole 28 of the front end sleeve positioning plate 12 and is fixed with the metal guide rod 7. All elastic rubber plates 13 form a circular arrangement; one front end elastic ring 14 is taken as an example, the original structure is an elastic rope, one end passes through all holes in the same circular plane of all elastic rubber plates 13 to form a closed elastic ring, the elastic rubber plate 13 and all front end elastic rings 14 form an elastic structure, which can form a cage structure or a bell mouth structure, and the number of inelastic hauling ropes 15 and elastic rubber plates 13 is the same. One inelastic hauling rope 15 is taken as an example, the inelastic hauling rope 15 is parallel to the axis of the tail top block 4 in the tubular device box, the front ends of the inelastic hauling ropes 15 are fixed to the front end of the elastic rubber plates 13 and the tail ends pass through the hole of the annular positioning plate in turn and finally are fixed on the tail end fixing box body 3. After the installation process, all the inelastic hauling ropes 15 form a cylindrical tubular structure, and all the inelastic hauling ropes 15 are in tension state.

The inelastic linkage rope 17 is installed between the tail end fixing box 3 and the tail end sleeve positioning plate 5. One end of the inelastic linkage rope 17 is fixed on the tail end driving case 20, and the other end passes through the hole 29 on the surface of the push plate 18, bypasses all the inelastic hauling ropes 15 arranged in a circle, passes through another hole 29 on the push plate 18 and is fixed on the tail end driving case 20 to form a closed ring, and all the inelastic hauling ropes 15 are closed inside the ring. When the hydraulic rod 19 controls the push plate 18 to move upward, the annular center formed by the inelastic linkage rope 17 shrinks, resulting in the axial movement of the elastic hauling rope 15 to the tail end, thus tightening the front end of the elastic rubber plates 13, and forming a horn mouth structure at the front end. When the pushing plate 18 moves downward, the ring formed by the inelastic linkage rope 17 expands, the front end of the AUV launch and recovery device forms a cage structure under the action of the elastic rubber plate 13 and the front end elastic ring 14.

Figure 2:
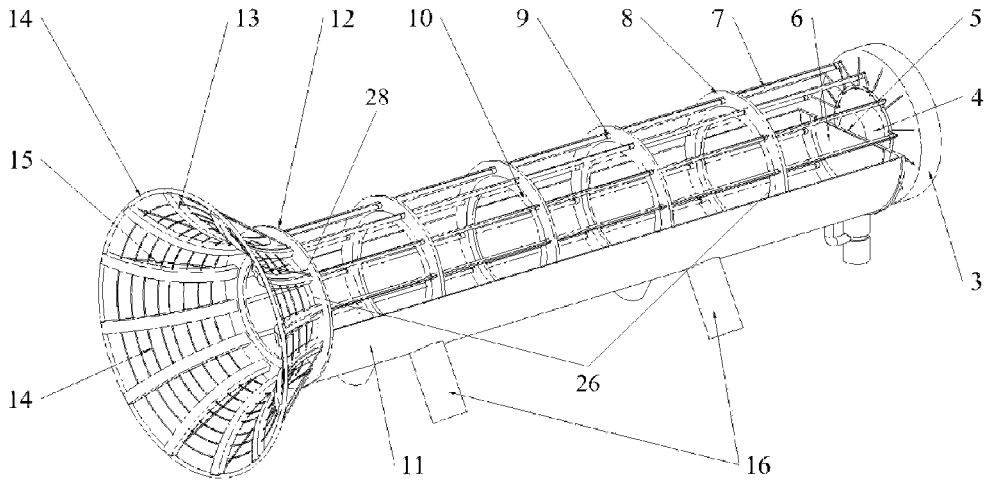
FIG. 2 shows a partial sectioned view of the AUV launch and recovery device.
Figure 3:
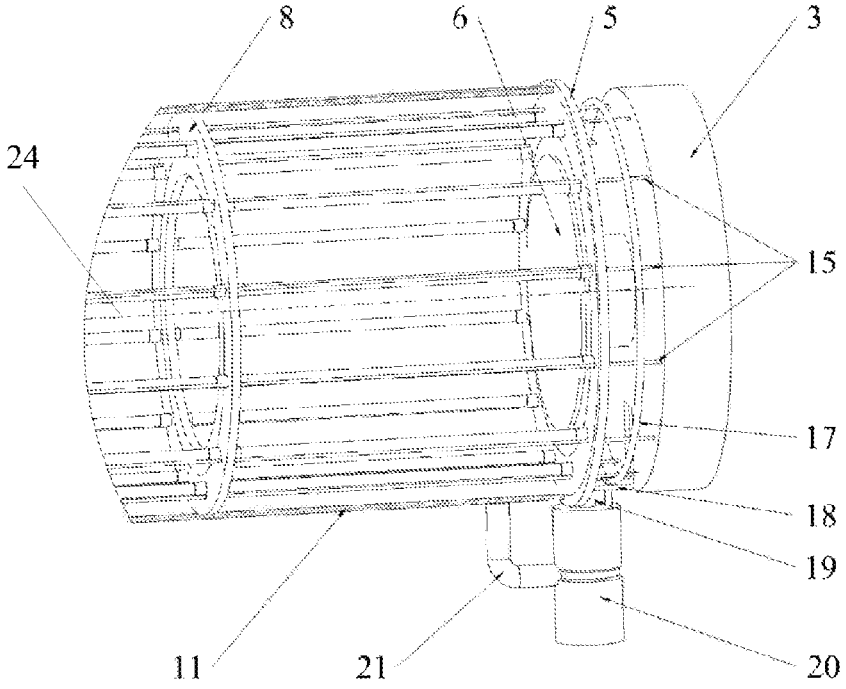
FIG. 3 shows a partial view 1 of a driving device when the AUV launch and recovery device is under a condition that AUVs are locked.
Figure 3A:
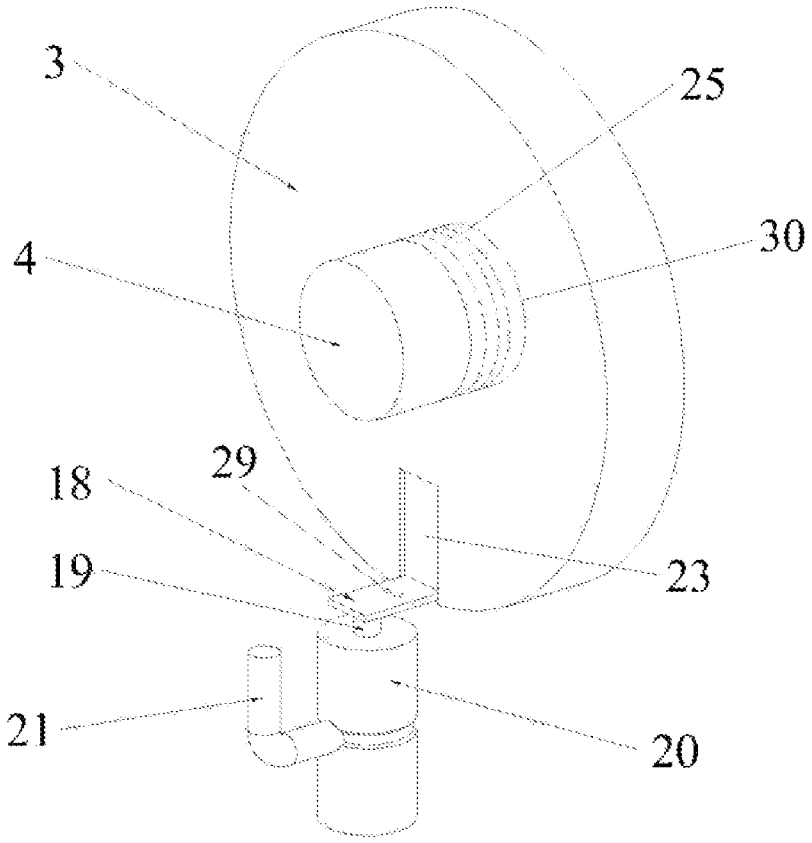
FIG. 3*a* shows a partial view 2 of the driving device when the AUV launch and recovery device is under a condition that the AUVs are locked.

Refer to FIG. 2 and FIG. 3*a*, the tail end fixing box body 3 is connected with the tail end limit displacement block 4 by threads 25, and the tail end limit displacement block 4 is connected with the tail end sleeve positioning plate 5 by screws and welding. The impact cushion 6 is fixed to a front end surface of the tail end sleeve positioning plate 5 by screws.

Refer to FIG. 2, twelve metal guide rods 7 are arranged in a ring with the same spacing angle, and the tail end is connected to the tail end sleeve positioning plate 5 through thread and welding; each AUV positioning plate 8 needs to be axially positioned on the guide rods 7 by using two guide rod positioning sleeves 9, and inner ring wall diameters of the guide rod positioning sleeves 9 are in interference fit with outer wall diameters of the guide rods 7; and the elastic AUV positioning rings 10 are fixed to inner ring walls of the annular AUV positioning plates 8 by pins. All annular AUV positioning plates 8, guide rod positioning sleeves 9, AUV positioning rings 10 and the front end sleeve positioning plates 12 are installed in the same way we just give.

Figure 2A:
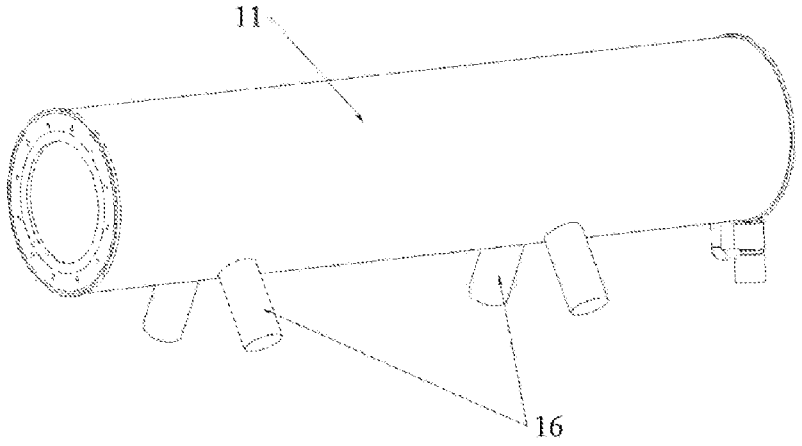
FIG. 2*a* shows a structure diagram of an external sleeve and a connecting device of the AUV launch and recovery device.

Refer to FIG. 2*a*, after the four annular AUV positioning plates are installed, a tail end of the external sleeve 11 is connected to the tail end sleeve positioning plate 5 by screws, and then, the front end sleeve positioning plates 12 and the matched AUV positioning rings 10 are installed; and the front end sleeve positioning plates 12 are connected to the front end of the external sleeve 11 by screws, so that sleeve positioning is finished.

A tubular device box body recovery section is formed by the tail end sleeve positioning plate 5, the guide rods 7, the four annular AUV positioning plates 8, the external sleeve 11, the front end sleeve positioning plates 12, the matched guide rod positioning sleeves 9, and the AUV positioning rings 10; and the tubular device box body recovery section is an integral rigid body.

Two pairs of brackets 16 are fixedly connected to the surface of the external sleeve 11, which can be used to connect other bases or hydraulic devices, so that the AUV launch and recovery device not only can be placed inside the large underwater platform, but also be suspended outside as an external load.

A tail end of each elastic rubber plate 13 is connected with a front end of each metal guide rod 7 by thread, and twelve elastic rubber plates 13 are combined into an elastic integral structure by using nine front end elastic rings 14; the most front end of each elastic rubber plate 13 is connected with a front end of one inelastic hauling rope 15 by screws, and a tail end of the inelastic hauling rope 15 is fixedly connected with the tail end fixing box body 3; and after completion of installation, it should be ensured that the inelastic hauling ropes 15 are in a tensioning state when the launch and recovery device is in the closed state.

One end of the inelastic linkage rope 17 is fixed on the tail end driving case 20, the other end passes through the hole 29 on the surface of the push plate 18, bypasses all the inelastic hauling ropes 15 arranged in a circle, passes through another hole 29 on the push plate 18 and is fixed on the tail end driving case 20 to form a closed ring, and all the inelastic hauling ropes 15 are closed inside. The pushing plate 18 pushes upward to shrink the annular center formed by the inelastic linkage rope 17, so that the elastic hauling rope 15 moves axially.

The push plate 18 is welded and fixed to the hydraulic rod 19, one side of the tail end of the push plate 18 is clamped in the groove 23 of the tail end fixing box body 3, and the hydraulic device 19 is placed in the tail end driving case 20, fixed by screws, and sealed with a sealing ring. In order to ensure the positioning of the tail end driving case 20, the tail end driving case 20 is fixed to the driving case positioning tube 21 by welding and threaded connection, and the driving case positioning tube 21 is fixed to the external sleeve 11 by welding and threaded connection.

After all installation procedures of the AUV launch and recovery unit are completed and the front-end guide cover is set to be closed, in this state, it must be ensured that all the inelastic hauling ropes 15 are in tension and straight state, and that the inelastic linkage ropes 17 and the pushing plate 18 exert a small amount of pressure on the inelastic hauling ropes 15.

When the XLUUV 1 launches the AUV 22, the front end forms a flared shaped structure, and the AUV 22 leaves the device box by AUV's own power, and then forms a cage structure in the front end under the elastic action of the front end elastic ring 14 and the elastic rubber plate 13.

When the XLUUV 1 recovers the AUV 22, the front end forms a flared shaped structure, and the AUV 22 runs to be close to the XLUUV 1. Equipment of a sonar, a signal transponder and the like which are installed in the box automatically navigates the AUV 22 to be aligned to the range of the flared shaped guide cover and lead the AUV 22 to enter the device box 2 so that the AUV 22 is fixed, then a cage structure is formed in the front end under the elastic action of the front end elastic rings 14 and the elastic rubber plate 13, and the AUV recovery task is finished.

Such detachable launch and recovery device has a simple and compact structure; due to self-propulsion of the AUV, the relevant AUV launch system does not need to be installed in the device box; if the AUV is permitted to be in a wet storage state, a maintenance system is not needed, and the external sleeve can be removed as appropriate; and if the AUV is required to be in a dry storage state, a maintenance device can be additionally arranged in the external sleeve.

Figure 6:
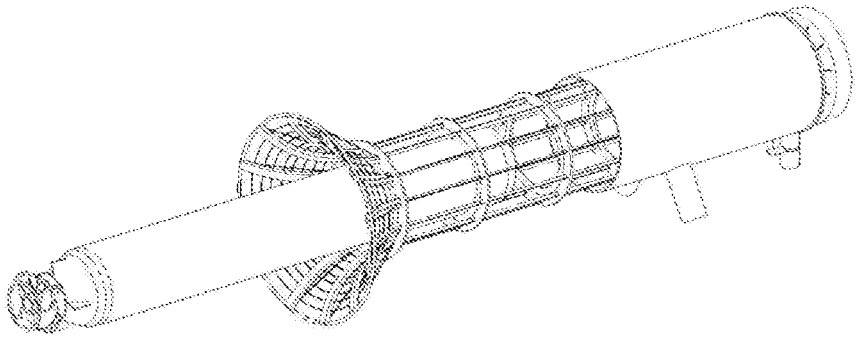
FIG. 6 shows a schematic diagram of the AUV launch and recovery device performing launch/recovery.

In FIG. 3 and FIG. 6, when entering the AUV launch state, a control system sends a signal for controlling the hydraulic device 19 to start, so that the push plate 18 moves upwards along the groove 23 in the tail end fixing box body 3; therefore, the ring formed by the inelastic linkage rope 17 shrinks toward the center, enabling the inelastic linkage rope 17 to give the inelastic hauling ropes 15 force in the collapsed state, so that the inelastic hauling ropes 15 move toward the tail axially; if the tail end fixing box body 3 is regarded as a coordinate origin, a Cartesian right-handed coordinate system is established, namely that the inelastic hauling ropes 15 move toward the tail end, and the elastic rubber plates 13 are bent outwards through relative motion; at the moment, a sensor is used for measurement to determine that the rubber plates 13 are bent outwards indeed; if the sensor detects and determines that the rubber plates 13 are not bent outwards, the control system controls the hydraulic driving to return to the closed state; and reopening is performed till the rubber plates 13 are bent outwards and reach a preset position, so that a recovery end is in the stable open state circumferentially. At the moment, the front end forms a flared shaped structure, and the AUV 22 is launched outside the device box 2 by own power.

Figure 4:
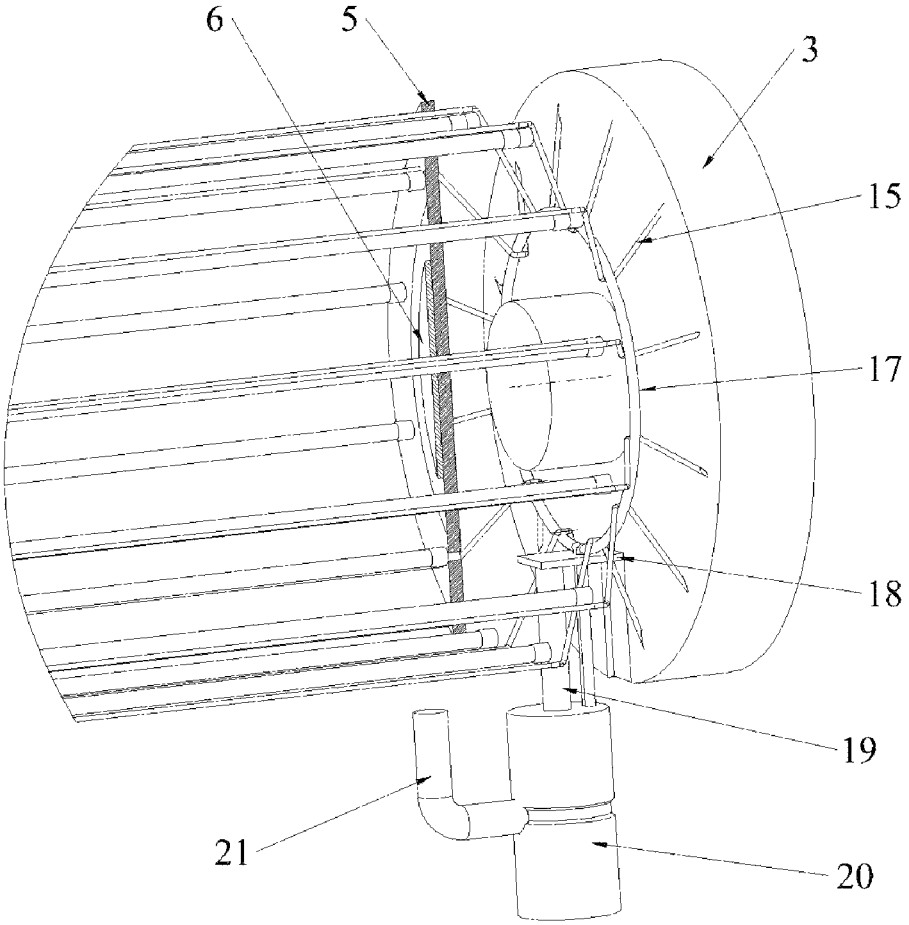
FIG. 4 shows a partial sectioned view of a driving device when the AUV launch and recovery device is in an open state.
Figure 4A:
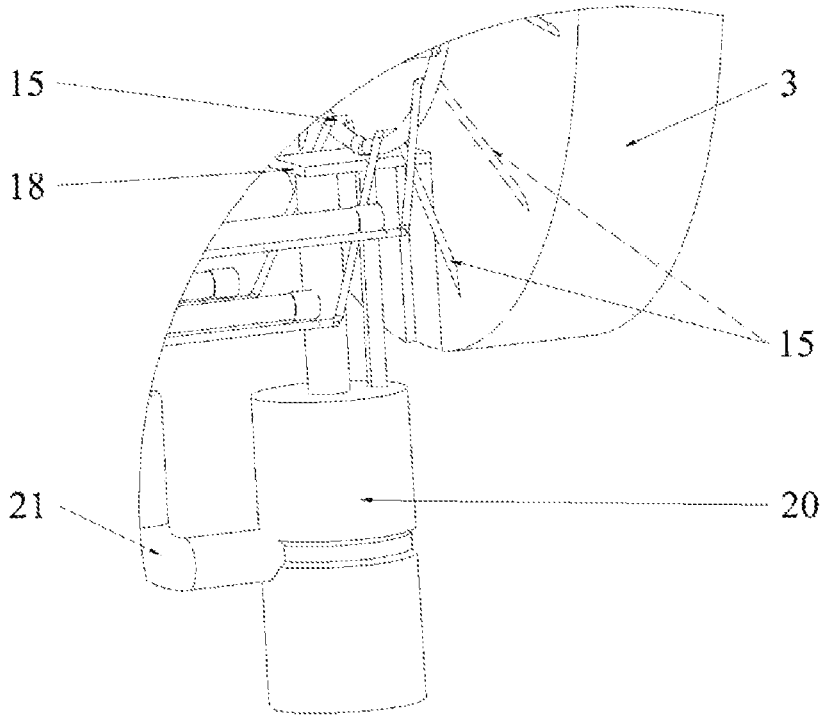
FIG. 4*a* shows a partial enlarged view of the driving device when the AUV launch and recovery device is in an open state.

In FIG. 4 and FIG. 4*a*, after the sensor determines that the launch is completed, the control system controls the hydraulic system to reset, so that the push plate 18 moves downward to the original position, the elastic rubber plate 13 gradually recovers to bend inward, the inelastic hauling ropes 15 and the inelastic linkage rope 17 are reset, and the guide cover is closed; in the closed state, the inelastic hauling ropes 15 are in the tension state, and the elastic rubber plate 13 is always bent inward depending on the tension of the front end elastic ring 14, so that the AUV launch and recovery device is closed, and it is not easy to open under the action of external force.

Figure 5:
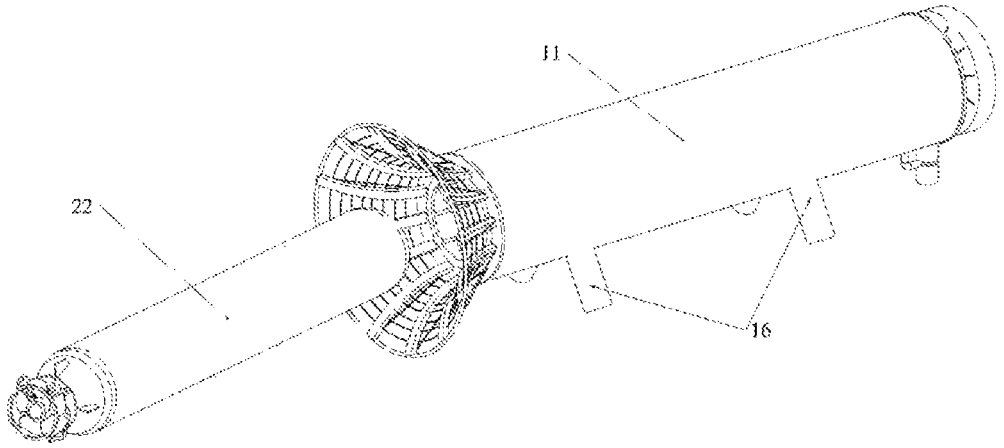
FIG. 5 shows a schematic diagram of the AUV launch and recovery device waiting for recovery.

In FIG. 5, when the XLUUV 1 is ready to recover AUV 22, the hydraulic rod of the hydraulic device 20 moves upward to form a flared shaped structure at the front end, waiting for the AUV 22 to enter the tubular device box 2.

In FIG. 6, after regulation of an approach attitude of the AUV 22, the head of AUV enters the flared shaped guide cover, and can be pushed into the tubular device box body recovery section along the flared shaped guide cover under AUV's own power, so that an axis of the AUV 22 is approximately aligned with that of the tubular device box body recovery section. At the moment, the sensor is used for detection; and once a distance between the head of the AUV 22 and the tail end sleeve positioning plate 5 reaches ½ of length of the tubular device box body recovery section, the hydraulic device 20 is controlled to start to reset, the push plate 18 moves downwards, and the guide cover is retracted gradually.

Figure 7:
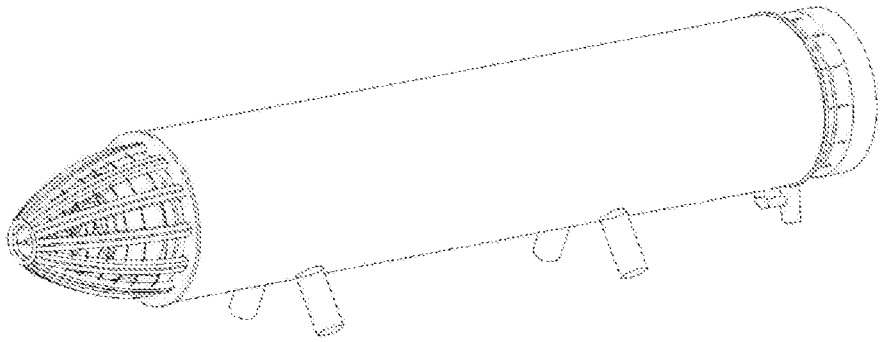
FIG. 7 shows a schematic diagram of the AUV launch and recovery device in a recovery completion state.

In FIG. 7, the AUV 22 passes through the four positioning plates 8 based on own power, and since the inner diameter of the AUV positioning rings 10 is slightly smaller than the diameter of the rotating part in the middle of the AUV 22, the AUV positioning is completed under the annular AUV positioning plates 8 and the elastic action of the elastic AUV positioning rings 10.

When AUV 22 has passed through all positioning plates but has not collided with impact cushion 6, it is necessary to ensure that the hydraulic device 19 has been reset and the front end forms a cage structure.

Then the AUV collides slightly with the impact cushion 6. After the AUV head navigation system determines that the AUV position is stable, the AUV 22 stops the output power; the elastic rubber plates 13 and the front end elastic rings 14 form a cage structure under the elastic recovery force; and the recovery of the AUV has been completed.

Ropes, namely the inelastic hauling ropes 15, mentioned in the patent jointly consist of inelastic hauling ropes and rubber sleeves outside the ropes, and the ropes and the matched rubber sleeves are both made of materials having properties of low elasticity and high resistance to wear and corrosion; and the corrosion resistance of the ropes is improved. Short for the inelastic hauling ropes, and a structure and a material of the inelastic linkage rope 17 are the same as those of the inelastic hauling ropes 15.

The original structure of one front-end elastic ring 14 is a composite elastic rope, it is jointly consist of ropes and rubber sleeves outside the ropes, and the ropes and the matched rubber sleeves are both made of materials having properties of medium elasticity and high resistance to wear and corrosion; and the corrosion resistance of the ropes is improved. The two ends of the rope can be connected by thread connection method to form a closed ring.

Figure 8:
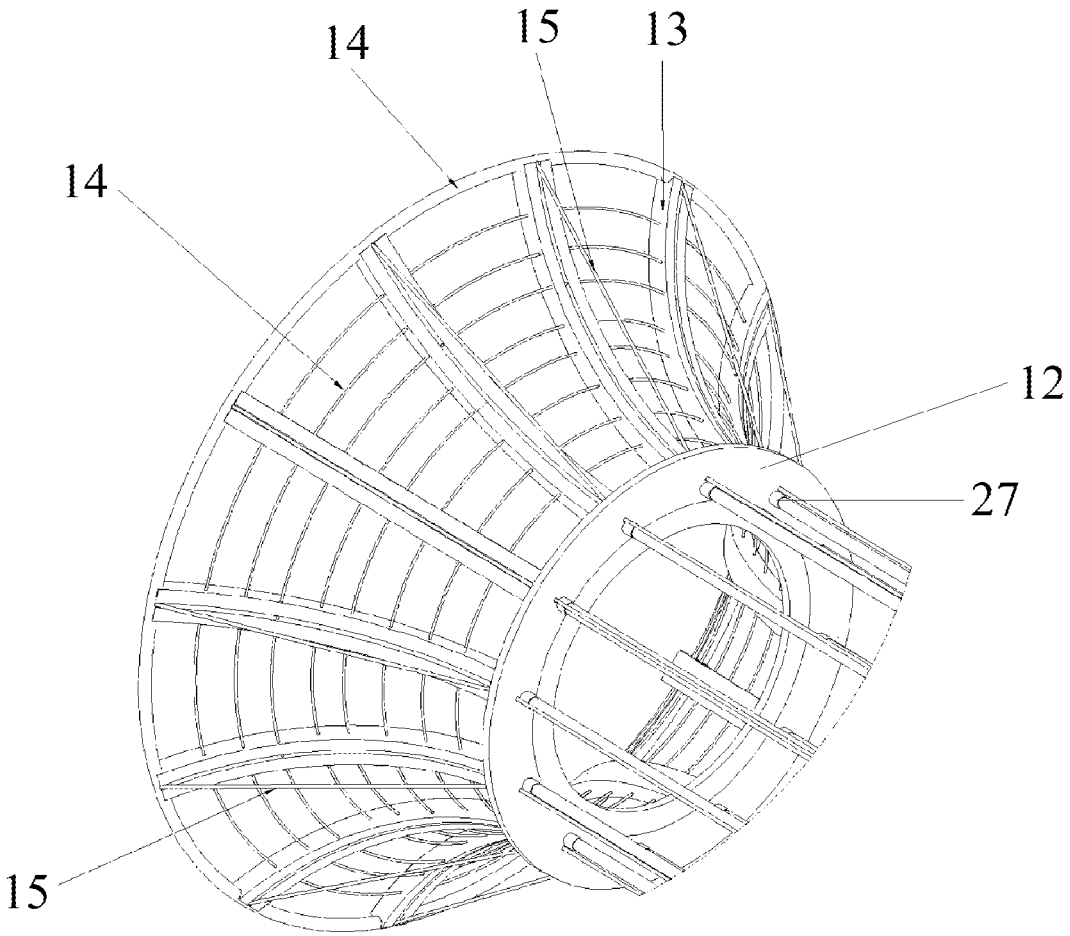
FIG. 8 shows a partial view of a guide cover of the AUV launch and recovery device.

In FIG. 8, twelve elastic rubber plates 13 are combined into an elastic integral structure by using nine front end elastic rings 14, and the diameter of the elastic ring 14 installed at the front end of the elastic rubber plate 13 is larger than that of the elastic rings 14 installed at other positions of the elastic rubber plate 13.

Although examples of the present disclosure have been illustrated and described, it can be understood that the above examples are exemplary and cannot be construed as a limitation to the present disclosure.

What is claimed is:

1. An autonomous underwater vehicle (AUV) launch and recovery device driven by an elastic linkage mechanism for an extra-large unmanned underwater vehicle (XLUUV), comprising:

a tail end fixing box body, a tail end limit displacement block, a tail end driving case, a hydraulic device, a push plate, a tubular device box and an external sleeve, wherein the AUV launch and recovery device is a frame type tubular structure, a front end of the AUV launch and recovery device is a recovery end, a tail end of the AUV launch and recovery device is closed, and is coaxial fixed with the tail end fixing box body through the tail end limit displacement block;

a front end face of the tail end fixing box body is processed with a groove, the groove is processed in a radial direction of the tail end fixing box body;

the push plate is parallel to a central axis of the AUV launch and recovery device, and one end of the push plate and the groove of the tail end fixing box body are installed in a cooperation manner; the hydraulic device is installed in the tail end driving case, and a hydraulic rod of the hydraulic device extends out of the tail end driving case; the push plate is fixed to the hydraulic rod, and the tail end driving case controls movement of the hydraulic rod to make the push plate move radially in the groove;

the external sleeve is coaxially sleeved on a periphery of the AUV launch and recovery device, and is configured for fixing the AUV launch and recovery device to the XLUUV; and the tail end driving case is positioned by an L-shaped driving case positioning tube fixed to a peripheral surface of the external sleeve;

the tubular device box comprises:

a tail end sleeve positioning plate, an impact cushion, metal guide rods, annular AUV positioning plates, elastic AUV positioning rings, a front end sleeve positioning plate, elastic rubber plates, inelastic hauling ropes, front end elastic rings and an inelastic linkage rope, wherein the tail end sleeve positioning plate, the annular AUV positioning plates and the front end sleeve positioning plate are sequentially and coaxially arranged, and the metal guide rods are uniformly distributed circumferentially, and each of the metal guide rods penetrates through a corresponding hole in an edge of a corresponding one of the annular AUV positioning plates; one end of each of metal guide rods is fixed to an inner side surface of the tail end sleeve positioning plate, an other end of the metal guide rod is fixed to an inner side ring surface of the front end sleeve positioning plate, and all metal guide rods are arranged in a circle;

the tail end sleeve positioning plate adopts a circular plate structure, and the impact cushion is coaxially fixed to an inner side surface of the tail end sleeve positioning plate; the tail end sleeve positioning plate is coaxially fixed to the front end elastic rings; each of the annular AUV positioning plates and the front sleeve positioning plate is an annular structure, the annular structure is processed with two types of holes for installing the metal guide rods and the inelastic hauling ropes, and the elastic AUV positioning rings are coaxially installed on ring inner hole walls of the annular AUV positioning plates and a ring inner hole wall of the front end sleeve positioning plate; the elastic AUV positioning rings are made of elastic materials, and inner hole diameters of the elastic AUV positioning rings are smaller than an outer diameter of an AUV to be recovered;

the AUV to be recovered is located through friction and elastic force generated by elastic deformation; one end of each of the elastic rubber plates is installed with a threaded cylinder, which passes through an annular hole of the front sleeve positioning plate and is fixed with a corresponding one of the metal guide rods;

the elastic rubber plates form a circular arrangement; and one of the front end elastic rings is formed in an elastic rope, wherein one end of the elastic rope passes through holes in a same circular plane of the elastic rubber plates to form a closed elastic ring, wherein each of the front end elastic rings and the elastic rubber plates forms an elastic structure, which forms a cage structure or a bell mouth structure; wherein a number of the inelastic hauling ropes and a number of the elastic rubber plates are the same, wherein the inelastic hauling ropes are parallel to an axis of the tail end limit displacement block in the tubular device box, and a front end of each of the inelastic hauling ropes is fixed to a front end of a corresponding one of the elastic rubber plates and a tail end of the inelastic hauling rope passes through a hole of a corresponding one of the annular AUV positioning plates and is fixed on the tail end fixing box body, wherein the inelastic hauling ropes form a cylindrical tubular structure, and the inelastic hauling ropes are in a tension state;

the inelastic linkage rope is installed between the tail end fixing box and the tail end sleeve positioning plate, wherein one end of the inelastic linkage rope is fixed on the tail end driving case, and an other end passes of the inelastic linkage rope through a hole on a surface of the push plate, which bypasses each of the inelastic hauling ropes arranged in a circle, and passes through another hole on the surface of the push plate and is fixed on the tail end driving case to form a closed ring, wherein the inelastic hauling ropes are closed inside the closed ring, and the hydraulic rod controls the push plate to move upward or downward, and makes an annular center formed by the inelastic linkage rope shrink or expand, wherein the inelastic hauling ropes move axially by relative motion, and pull the front ends of the elastic rubber plates to open or close the front end elastic rings.

2. The AUV launch and recovery device driven by an elastic linkage mechanism for an XLUUV according to claim 1, wherein the tail end fixing box body adopts a cylindrical structure, and a threaded hole is formed in a center of the tail end fixing box body; the tail end limit displacement block is a stepped cylindrical structure, which is installed at the threaded hole of the tail end fixing box body through threads.

3. The AUV launch and recovery device driven by an elastic linkage mechanism for an XLUUV according to claim 1, wherein the tail end sleeve positioning plate and a plurality of the annular AUV positioning plates and the front end sleeve positioning plate are arranged equidistantly.

4. The AUV launch and recovery device driven by an elastic linkage mechanism for an XLUUV according to claim 1, wherein guide rod positioning sleeves are installed on each of the metal guide rods, which are installed on both sides of each AUV positioning plate respectively to prevent the AUV positioning plate from moving.

5. The AUV launch and recovery device driven by an elastic linkage mechanism for an XLUUV according to claim 1, wherein the inelastic hauling ropes are parallel to the axis of the tail end limit displacement block in the tail end fixing box body.

6. The AUV launch and recovery device driven by an elastic linkage mechanism for an XLUUV according to claim 1, wherein a number of elastic rubber plates is the same as that of the metal guide rods; and the elastic rubber plates form an approximate cylindrical structure after installation.

7. The AUV launch and recovery device driven by an elastic linkage mechanism for an XLUUV according to claim 1, wherein one end of the external sleeve is coaxially fixed to an inner ring surface of the front end sleeve positioning plate, and an other end of the external sleeve is coaxially fixed to the inner side surface of the tail end sleeve positioning plate.

8. The AUV launch and recovery device driven by an elastic linkage mechanism for an XLUUV according to claim 1, further comprising two pairs of sleeve brackets arranged in parallel, wherein the sleeve brackets are fixed to a bottom of the external sleeve, to fix the AUV launch and recovery device to the XLUUV or install the AUV launch and recovery device in the XLUUV.

* * * * *